US005809929A

United States Patent [19]

Garnes

[11] Patent Number: 5,809,929

[45] Date of Patent: Sep. 22, 1998

[54] BOAT COVER

[76] Inventor: Franklin Garnes, 5341 Upland St., Philadelphia, Pa. 19143

[21] Appl. No.: 942,889

[22] Filed: Oct. 2, 1997

[51] Int. Cl.[6] ..... B63B 17/02

[52] U.S. Cl. ..... 114/361; 114/364

[58] Field of Search ..... 114/343, 364, 114/361, 352, 353; 150/166

[56] References Cited

U.S. PATENT DOCUMENTS 3,438,073 4/1969 Brown ..... 114/361

4,223,414 9/1980 Dickson ..... 114/361

*Primary Examiner*—Ed L. Swinehart

[57] ABSTRACT

This a system for attaching a weather proof cover on to a boat that has protection for its interior. The cover assembly has a male/female connections that seals in a rubberized channel to make it weather tight. This improved cover attaches in four-piece assembly that slides on to the boat depending on boat specifications. All pieces of cover should be attached in there proper position. Holes on the lip of each panel should lined up in order to insert the thumb screws needed to hold down the cover in all four pieces. This design uses the boat's gunwales underside to hold each piece down before anyone can insert the screws. The profile of the hard top shell is custom designed to the shape of the boat for weatherized protection.

4 Claims, 3 Drawing Sheets

BOAT COVER

BACKGROUND OF INVENTION

The background is to cover the opening of boat when not in use. When the boat is parked on land, being transported or docked, this boat cover will reduce sun light, keeps dirt from entering boat and protects all objects inside the boat from weather, theft or vandalism. The boat cover works like a aerodynamic car resistance on the highway when being transported to location. Most boats suffer from canvas tops snapping because of weight of snow or rain. After a few years of weather battering, the canvas top is no longer protection for boat.

This newly designed boat cover has a rubber seal that works with its matting cover that will lock out all weather elements of nature. The boat cover is made from a plexi-glass, acrylic resin, plastic that has a smoked tint to prevent sunlight or people from looking inside of the cover. This is clearly an improvement for all boat owners. The hard shell four piece cover design is lightweight and can be assembled by one person. The attaching cover has enough play in its mounting holes to line up the ¼" turn thumb screws in each of the four panels under the gunwale. The cover also offers a tight fit on to the boat that would make it secure and likely to deter theft or vandalism.

SUMMARY OF THE INVENTION

Each piece of this four part cover slides on to boat. There are two front pieces and they have a left side and right side. The same for the back or rear pieces they also have a right and left part. Each part slides onto the boats' gunwale make sure that each panel is wrapped around the gunwale and all holes are aligned. The gunwale guard of the boat is needed to hold on to each panel and support the locking of each thumb screw when aligned. Each panel of the boat top has a rubber seal to secure a tight fit of its connecting parts.

The present invention provides an significant contribution to the boat cover art providing an aerodynamic attachment that mounts to gunwale for support. This cover allows more protection than any other boat cover. It is an object of the present invention to provide interior protection to a boat by all means. It has aerodynamics for wind resistance, less noise when traveling and will help gas mileage. It is a future object of the present invention to provide longer life of the interior of any boat that can use this present cover. This cover provides a easy assembly of its parts. The present invention provides flexible hard-shell to prevent destruction of its purpose while being outdoors. The present field of the invention is to have a replacement for boat lovers who want to take extra care of their boats interior.

BRIEF DESCRIPTION OF THE DRAWINGS

The invention shown here can be better illustrated by accompanying drawings.

DETAILED DESCRIPTION OF THE INVENTION

A great deal of improvement of this present invention is best understood after the consideration of how this four (4) piece covering system works. Conventional boat covers are made from more flexible or canvas type fabric. This new and present invention is made from a custom made plexi-glass. The special made shapes of each part of the boat cover is made by plexi-glass fabricator that can handle large shapes of plexi-glass Dupont as this patent requires.

Figure 1:
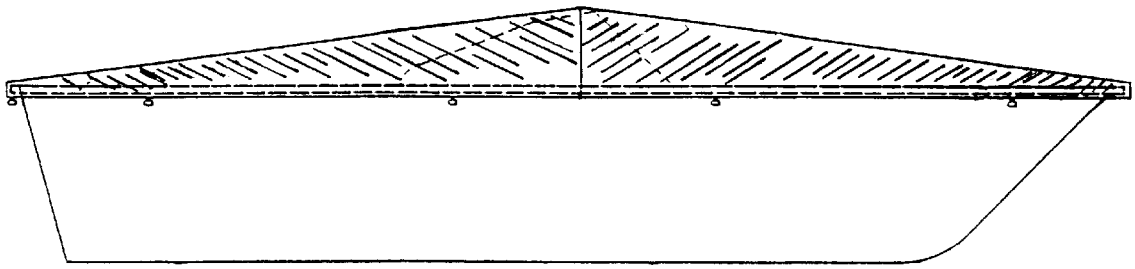
FIG. 1 is a profile of the boat equipped with its boat cover to show its finished look after cover is completely attached to the required boat.

As best show in FIG. 1 is a custom boat hard top cover. Also, the profile of this boat cover is designed to sit as low as possible without any interference of any other boat object. The connection of the boat cover between boat and boat cover is accurately aligned for mounting of the thumb screws to the boats gunwale as shown in FIG. 2, Reference No. 1 and Reference No. 2.

Figure 2:
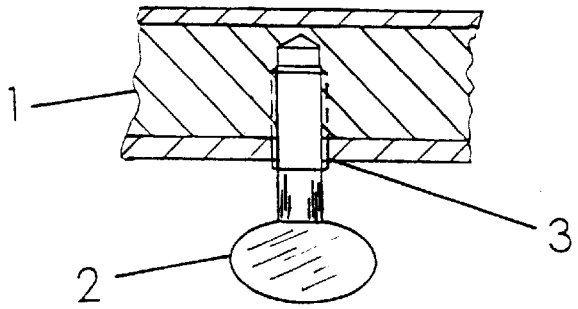
FIG. 2 is an enlarged sectional view of the boats gunwale, FIG. 2, showing the mounting of the boat top being retained by quarter turn screw, FIG. 2, that keeps the boat cover lined up and attached to the boat by use of the boat's gunwale for mounting support.
Figure 3:
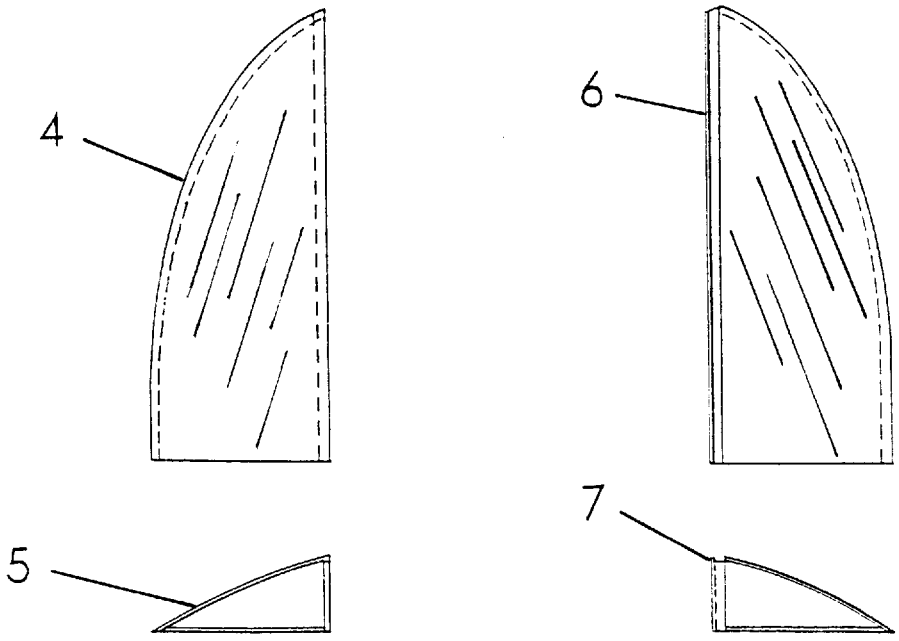
FIG. 3 is a top and rear view of the boat top front which works as a left and right side connection.

As shown in FIG. 2 a drilled and threaded holes are accurately placed around the boat's gunwale in order to mount the boat cover to the boat. These holes are connecting with ¼" turn thumb screws as shown in FIG. 2. Reference No. 2 with a threaded liner as shown in FIG. 2, Reference No. 3. Both items in FIG. 2 Reference No. 2 and Reference No. 3 are purchased from McMaster Carr Catalog. Reference No. 2 in FIG. is catalog no. Mc-1134 and Reference No. 3 in FIG. 2 is catalog no. Mc-3517. The thumb screw Reference No. 2 on FIG. 2 only needs a few turns to securely hold the device for boat. The connecting parts are used to make sure that the boat cover can only be aligned in order to insert the ¼" turn screws or it cannot securely be assembled as designed. FIG. 3 Reference No. 4, as best seen here, shows a top view of one of the panels of the boat top. This is the left side of the boat cover which is made to size by a custom plexi-glass fabricator that can handle large designs of plexi-glass (Dupont) such as this boat top. This is only one quarter of the tops assembly for completion. The shape of the left front panel Reference No. 4 in FIG. 3 is custom shaped to the requirements needed by the boat. The left front panel is designed with a lip that slides under the gunwale to help hold down the panel once the panel is aligned with the holes needed to apply the screws as described in FIG. No. 2, Reference No. 2. The panel also has a connecting channel that can only work with its opposite part in order to secure togetherness of its connecting part. As best shown in FIG. 3 Reference No. 5 is the profile of the left front panel. This view of the panel show that it's a tapered design and has a angle to show that almost nothing will sit and stay on this boat cover.

As best seen here on FIG. 3, Reference No. 6 is the same panel as described and detailed in FIG. 3, Reference No. 4, but it is a right side panel of the boat cover that is made to meet the same requirements as the left side description. This is only one quarter of the tops assembly for full completion. The shape of this right front panel Reference No. 6, FIG. 3 is custom shaped to the requirements needed by the boat. The right front panel is designed with a lip that slides under the gunwale to help hold down the panel once the panel is aligned with hole needed to apply the screws as described in FIG. No. 2, Reference No. 2. The panel also has a connecting channel that can only work with its opposite part in order to secure a tight lock between its connecting part, Reference No. 4 on FIG. 3. Once again one panel slides on to the other in order to lock the connection of the two as required. As best shown in FIG. 3, Reference No. 7 is the profile of the right front panel. This view of the panel shows that it has a tapered design and is angled the same as its connecting part, Reference No. 4 in FIG. 3 pending on the boats requirements for the design angle.

Figure 4:
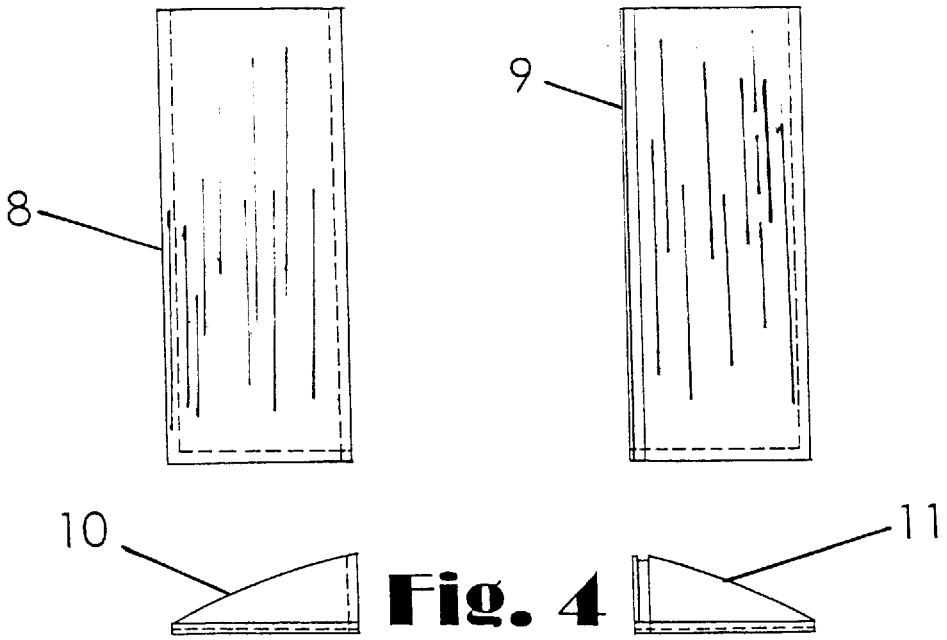
FIG. 4 is a top and rear view of the boat top back panels. They connect also to complete the boat tops four (4) piece assembly.

As best seen here Reference No. 8 in FIG. 4 is a top left side rear panel of the boat top cover. The front panel is to order by a custom plexi-glass (Dupont) fabricator. This is also only one quarter of the tops assembly for completion. The shape of the left rear panel, Reference No. 8 in FIG. 4 also is custom shaped to the requirements needed by the boat. The left real panel is designed with a lip that slides under the gunwale to help hold down the panel once the panel is aligned with the holes need to apply the screws as described in FIG. 2, Reference No. 2. This panel also has a tapered design that matches the left front panel angle, Reference No. 4 and 5 in FIG. 3. This left rear panel also tapers downward from the front to the rear end of the boat. You will have to refer back to the side profile on the boat cover on Page No. 2, FIG. No. 1 which shows a profile of the front and real panels in connection. This is a right side profile in full assembly. The left rear panel also has a connecting channel that can only work with its opposite part in order to secure together with each other when assembled.

As best show here on FIG. 4, Reference No. 9 is a top right side rear panel of the boat top cover. It is also made to order by a custom plexi-glass (Dupont) fabricator just as the front panels require. This is only one quarter of the cover's assembly for completion. The shape of the left rear panel, Reference No. 9 in FIG. 4 also is custom shaped to the requirements needed by the shape of boat. The right rear panel designed with a lip that slides under the gunwale to help hold down the panel once the panel is aligned with needed holes to apply the screws as described in FIG. 2, Reference No. 2. The panel also has a tapered design that matches the right front panel's angle, Reference No. 6 and 7 in FIG. 3. This right rear panel also tapers downward from the front of the panel to the rear end. You will also have to refer back to the side profile on the boat cover on Page 2, FIG No. 1 which shows a profile of the front and rear panels in assembly. Like the front panels in FIG. 3, they connect the two rear panels the same. They can only work with their opposite part in order to secure together with each other when assembled.

Figure 5:
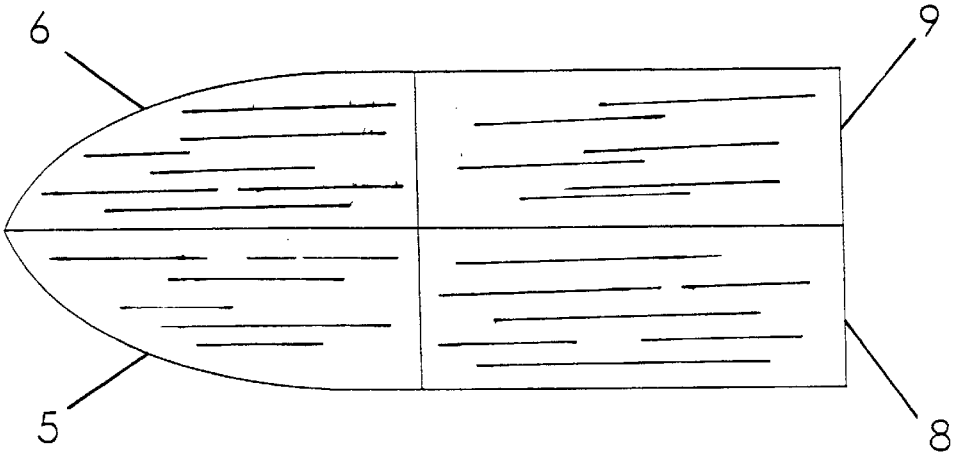
FIG. 5 is plan view of the boat's top. This view shows the cover attachment in accordance with each part being assembled.
Figure 6:
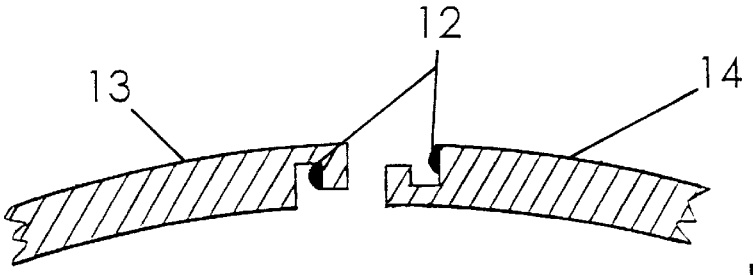
FIG. 6 is a sectional view that show the channels of the panels. These channels are used in all four panels.

This improved structure with long lasting weather tight quality attaches to boat's gunwales. As best shown in FIG. 5 is a plan view of the boat cover layout. As each of the four piece design was previously described, you can now see how each piece will look in assembly as a whole part. Reference No. 4 connects to Reference No. 6 connects to Reference No. 7 in FIG. 5. Reference No. 8 connects to Reference No. 7 and Reference No. 8 connects to the front panel, Reference No. 6. As shown in the drawing of the boat cover in its plan view, FIG. No. 5. Not one of the panels can do without each other for strength. When in assembly as shown here, this boat cover has a tight seal stable mounting that has an attractive look. The drawing in FIG. No. 6 is best described as a cross-sectional hatching, broken out view needed to show the channels that are machined out by a custom plexi-glass (Dupont) fabricator to make the right fit of the panels as needed to give this design the concept and engineering as planned by the inventor. Reference No. 13 in FIG. No. 6 is a profile of the channel for the left side of the boat cover. In this view of Reference No. 13 is the same channel contour for panels. Reference No. 4 and Reference No. 7 are made exactly alike for the left panels and the same channel contour for panels Reference No. 6 and Reference No. 8 are made exactly alike for the right side of the boat cover design. Item Reference No. 12 in FIG. No. 6 is showing the rubber sealant that helps keep the boat cover weather proof. The rubber sealant as best shown in Reference No. 12 in FIG. 6 shows the locations of applying the rubber seals. The rubber seal is a weather or window required striping that can be found in any auto or industrial supplier that carries various types. The rubber sealant is applied the entire length of each panel. It is used in the section shown in Reference No. 12 on FIG. 6. The application of the rubber sealant is glued into place after custom cutting each seal the length of each panel requirement. The type of glue needed for the assembly of the rubber sealant is a silicone compound made by Dupont which is stable over a wide range of temperatures. After applying the silicone glue and applying the rubber seals, 24 hours is need for drying.

Figure 7:
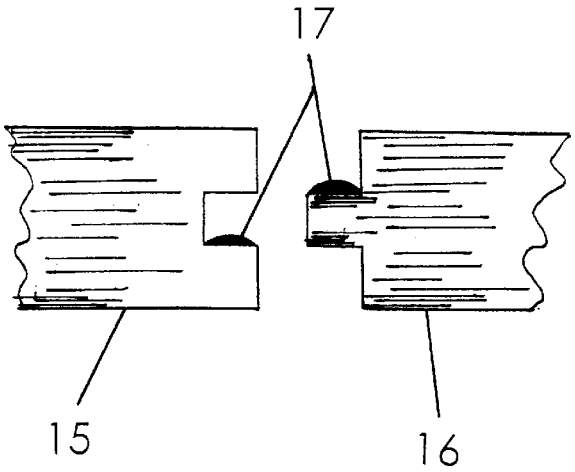
FIG. 7 is a broken view showing fitting between both parts of the front left and right pieces and the back left and right pieces that keeps the two halves tight in assembly.

On FIG. No. 7, the joining connection of the panels going from left to right, if you were to use the plan view in FIG. No. 5, the line in the center is the line that represents the joint that describes the view of FIG. No. 7 and Reference No. 15 that connects to Reference No. 16 in FIG. 7. Reference No. 15 is the representation of the front panels, left front and right front. As best shown in Reference No. 5 and Reference No. 6 are the front panels. Reference No. 16 is the representation of the rear panels, left rear and right rear as shown in Reference No. 8 and Reference No. 9 in FIG. No. 5. Item Reference No. 17 in FIG. 7 shows the rubber sealant that helps keep the boat cover weather proof. The rubber sealant is the same as described earlier in the invention. The rubber seal is a weather or window stripping as required by the inventor. The rubber sealant is applied in the entire length of each panel, but also only to the side of each panel where Reference No. 17 is best showing to Reference No. 15 and Reference No. 16. The same glue type is used as described previously, which is a silicone compound made by Dupont. This glue is applied wherever rubber sealant is used on these panels mentioned in invention.

I claim:

1. A boat cover for use in combination with a boat having a hull, said hull having a gunwale arranged peripherally about the hull and extending outwardly therefrom, said cover comprising four individual rigid cover portions, each cover portion including an interfitting portion for mating with an interfitting portion on adjacent said cover portions, each said cover portion including a lip means on a lower edge thereof for underlying said gunwale of said hull and fastener means for extending through said lip means and engaging said gunwale for securing said cover in place on said hull.

2. A boat cover as set forth in claim 1 in which said cover portions are constructed from a rigid synthetic resin.

3. A boat cover as set forth in claim 1 in which said fastener means further comprises a plurality of thumb screws arranged about the periphery of the hull.

4. A boat cover as set forth in claim 1 in which said interfitting means further comprises seal means for providing a watertight connection between said cover portions.

* * * * *